US009910380B1

(12) United States Patent
Iino

(10) Patent No.: US 9,910,380 B1
(45) Date of Patent: Mar. 6, 2018

(54) IMAGE FORMING APPARATUS CONFIGURED TO FORM AN IMAGE ON AN IMAGE RECEIVING MEDIUM WITH A SPECIFIC MATERIAL WHICH EMITS VISIBLE LIGHT THROUGH IRRADIATION BY SPECIFIC LIGHT

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Seiji Iino, Yokohama Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/257,065

(22) Filed: Sep. 6, 2016

(51) Int. Cl.
*G03G 15/02* (2006.01)
*G03G 15/043* (2006.01)

(52) U.S. Cl.
CPC ..... *G03G 15/043* (2013.01)

(58) Field of Classification Search
CPC ..... G03G 15/043; G03G 15/04045
See application file for complete search history.

(56) References Cited

U.S. PATENT DOCUMENTS

2016/0011537 A1* 1/2016 Higuchi ..... G03G 15/04045 399/177

FOREIGN PATENT DOCUMENTS

JP 2014-110495 12/2014

* cited by examiner

*Primary Examiner* — Hoang Ngo
(74) *Attorney, Agent, or Firm* — Amin, Turocy & Watson LLP; Gregory Turocy

(57) ABSTRACT

In accordance with an embodiment, an image forming apparatus comprises an image forming section and a specific light source. The image forming section forms an image on an image receiving medium with a specific material which emits visible light through irradiation by specific light. The specific light source emits the specific light to the image receiving medium at a downstream side of the image forming section in a conveyance direction of the image receiving medium.

16 Claims, 4 Drawing Sheets

IMAGE FORMING APPARATUS CONFIGURED TO FORM AN IMAGE ON AN IMAGE RECEIVING MEDIUM WITH A SPECIFIC MATERIAL WHICH EMITS VISIBLE LIGHT THROUGH IRRADIATION BY SPECIFIC LIGHT

FIELD

Embodiments described herein relate generally to an image forming apparatus.

BACKGROUND

Conventionally, there is an image forming apparatus such as a multi-function peripheral (hereinafter, referred to as an "MFP") and a printer. The image forming apparatus is equipped with an image forming section for forming an image on an image receiving medium. The image forming apparatus is equipped with an ordinary light source for emitting visible light to the image receiving medium discharged from the image forming section.

In some instances, there is an image on the image receiving medium such as a barcode for sorting postcards which is desired not to be visually recognized through irradiation of the visible light. In this case, an image that is visually recognizable through irradiation of a specific light such as UV light is formed on the image receiving medium. However, in a case in which the image on the image receiving medium is visually recognizable through the irradiation of the specific light, when the discharged image receiving medium is irradiated with the visible light, there is a possibility that whether the image is normally printed on the image receiving medium cannot be confirmed.

DETAILED DESCRIPTION

In accordance with an embodiment, an image forming apparatus comprises an image forming section and a specific light source. The image forming section forms an image on an image receiving medium with specific material which emits visible light through irradiation by specific light. The specific light source emits the specific light to the image receiving medium at a downstream side of the image forming section in a conveyance direction of the image receiving medium.

In accordance with another embodiment, an image forming method involving forming an image on an image receiving medium with a specific material which emits visible light through irradiation by specific light; and emitting the specific light to the image receiving medium at a downstream position in a conveyance direction of the image receiving medium.

Hereinafter, an image forming apparatus 1 of an embodiment is described with reference to the accompanying drawings. Further, the same component is assigned with the same mark in each diagram.

Figure 1:
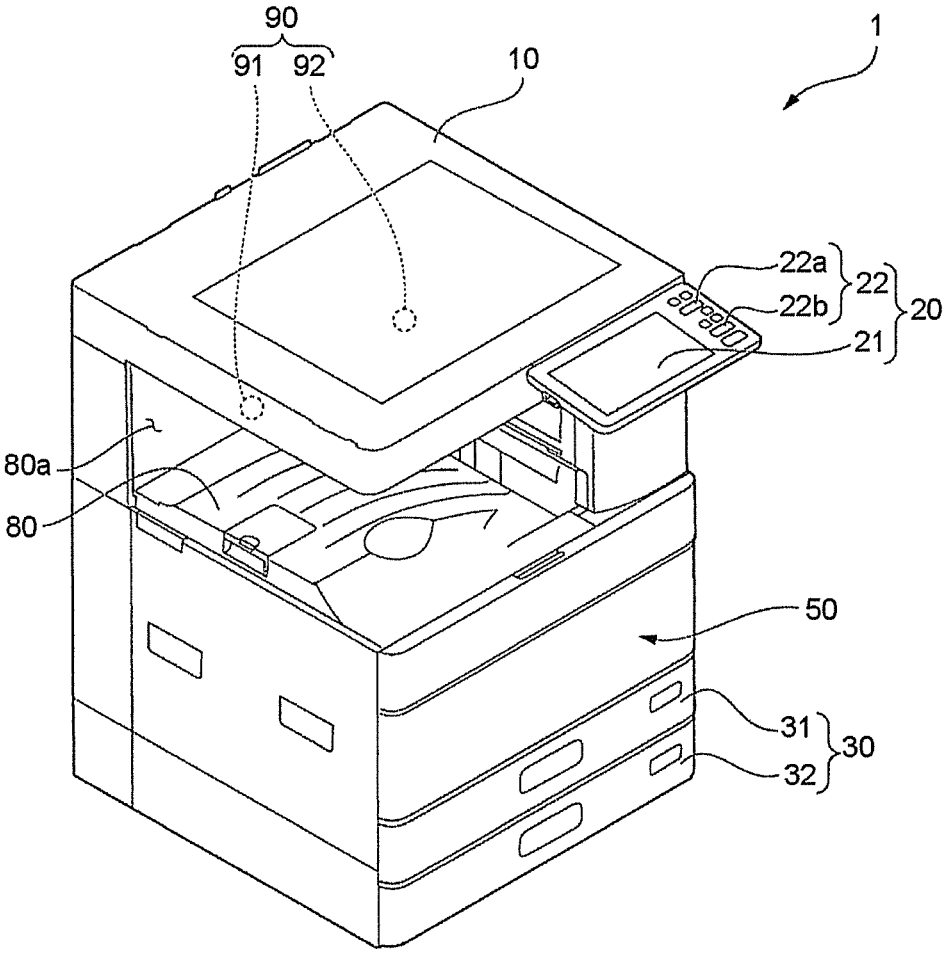
FIG. 1 is an external view illustrating an example of an image forming apparatus according to an embodiment.

FIG. 1 is an external view illustrating an example of the image forming apparatus 1 according to the embodiment. For example, the image forming apparatus 1 is an MFP (Multi-Function Peripheral). The image forming apparatus 1 reads an image formed on a sheet-like image receiving medium (hereinafter, referred to as a "sheet") such as a paper to generate digital data (image file). The image forming apparatus 1 forms an image on the sheet with toner based on the digital data.

Figure 2:
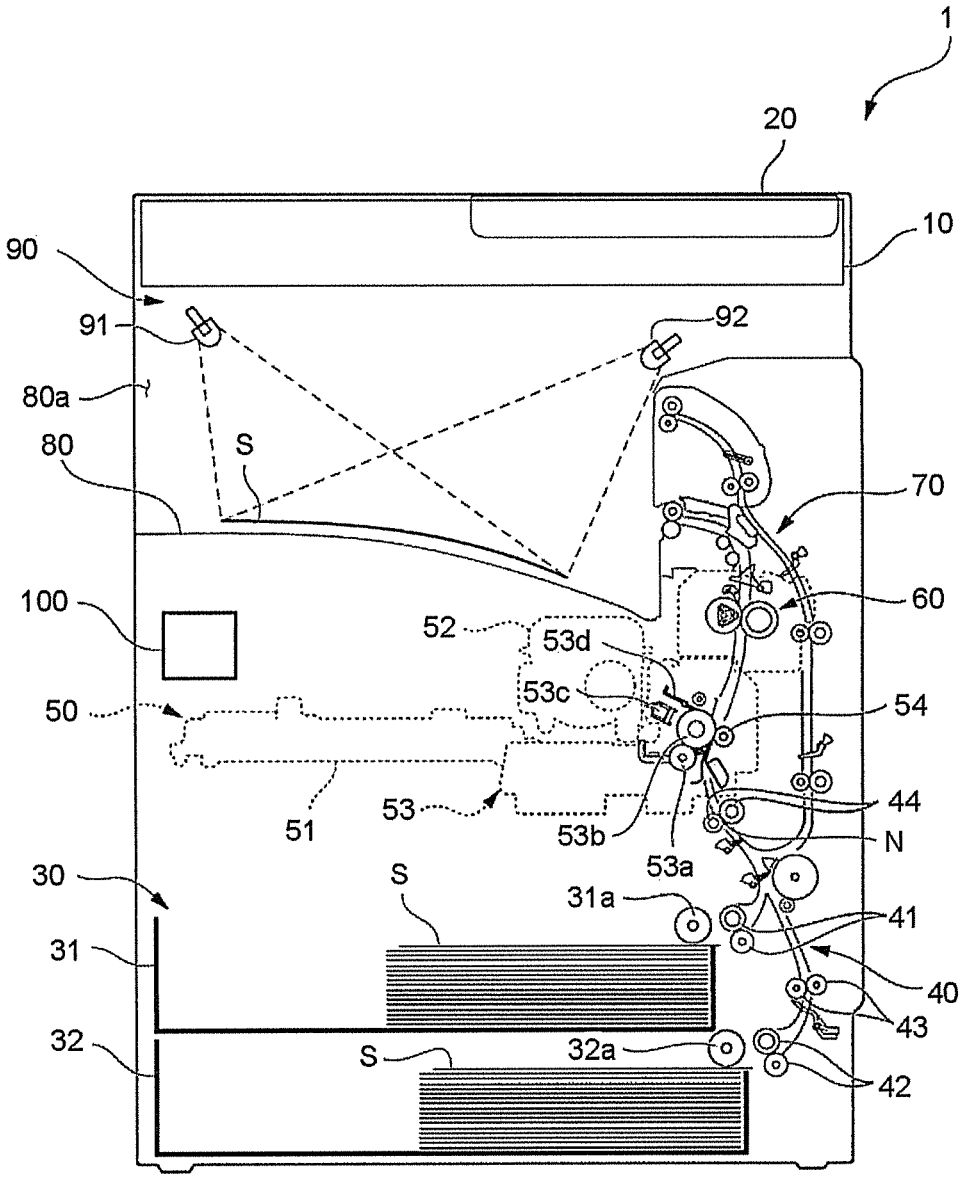
FIG. 2 is a diagram illustrating an example of the schematic configuration of the image forming apparatus according to the embodiment.

FIG. 2 is a diagram illustrating an example of the schematic configuration of the image forming apparatus 1 according to the embodiment. The image forming apparatus 1 is an electrophotographic type image forming apparatus.

The image forming apparatus 1 is equipped with an image reading section 10, a control panel 20, a sheet housing section 30, a conveyance section 40, an image forming section 50, a fixing section 60, a reversing unit 70, a discharge tray 80, an irradiation section 90 and a control section 100.

First, the image reading section 10 is described.

The image reading section 10 reads an image formed on the sheet with a sensor to generate digital data. For example, the image reading section 10 is a color scanner. The color scanner includes a CIS (Contact Image Sensor), a CCD (Charge Coupled Device) and the like.

Next, the control panel 20 is described.

As shown in FIG. 1, the control panel 20 is equipped with a display section 21 and an operation section 22.

The display section 21 operates as an output interface to display characters or images. The display section 21 displays various information relating to the image forming apparatus 1. For example, the display section 21 is a display device such as a liquid crystal display and an organic EL (Electro Luminescence) display.

The operation section 22 operates as an input interface to receive an instruction from a user. The operation section 22 outputs a signal corresponding to an operation executed by the user to the control section 100 (refer to FIG. 2). Further, the display section 21 and the operation section 22 may be constituted as an integrated touch panel.

Next, the sheet housing section 30 is described.

The sheet housing section 30 is equipped with a plurality of (for example, two in the present embodiment) sheet feed cassettes 31 and 32.

As shown in FIG. 2, the sheet feed cassettes 31 and 32 respectively house sheets S with prescribed sizes and categories. The sheet feed cassettes 31 and 32 are equipped with pickup rollers 31*a* and 32*a*, respectively. The pickup rollers 31*a* and 32*a* respectively pick out the sheets S from the sheet feed cassettes 31 and 32 one by one. The pickup rollers 31*a* and 32*a* supplies the sheet S picked out to the conveyance section 40.

Next, the conveyance section 40 is described.

The conveyance section 40 conveys the sheet S between the sheet housing section 30 and the image forming section 50. the conveyance section 40 is equipped with sheet feed rollers 41 and 42, a conveyance roller 43 and a resist roller 44. The sheet feed rollers 41 and 42 respectively convey the sheet S supplied by the pickup rollers 31*a* and 32*a* to the resist roller 44. The resist roller 44 supplies the sheet S to the image forming section 50. In detail, the resist roller 44 conveys the sheet S to a transfer roller 54 side according to timing at which the transfer roller 54 of the image forming section 50 transfers a toner image onto the sheet S. The resist roller 44 conveys the sheet S to the transfer roller 54 side after front end of the sheet S is aligned at a nip N.

Next, the image forming section 50 is described.

The image forming section 50 forms an image on the sheet S with the toner. The image forming section 50 forms an image based on image data read by the image reading section 10 or image data received from an external device. For example, the image formed on the sheet S is an output image referred to as a hard copy, print out and the like.

Next, the toner is described.

In the present embodiment, the toner includes UV toner (specific material) and ordinary toner (ordinary material).

The UV toner has a characteristic of emitting visible light through irradiation by UV light (specific light). In other words, the UV toner is the toner that is visually non-recognizable through irradiation by visible light and is visually recognizable through irradiation by UV light. The UV toner may be optional toner as long as the toner has the characteristic described above. UV light (specific light in this disclosure) has a wavelength from 10 to 380 nm. Visible light has a wavelength from 400 to 700 nm.

The ordinary toner is visually recognizable toner through irradiation by visible light. For example, the ordinary toner is yellow (Y), magenta (M), cyan (C), black (K) toner.

Next, the configuration of the image forming section 50 is described.

The image forming section 50 is equipped with an exposure section 51, a toner cartridge 52, an image forming section 53 and the transfer roller 54.

The exposure section 51 irradiates (exposes) a photoconductive drum 53*b* of the image forming section 53 with the light. The exposure section 51 is equipped with an exposure light source such as a laser or an LED.

The toner cartridge 52 houses toner with the category thereof corresponding to the toner to be handled. In the present embodiment, the toner cartridge 52 houses the UV toner and the ordinary toner.

The image forming section 53 forms the image with the toner.

The image forming section 53 is equipped with a developing device 53*a*, the photoconductive drum 53*b*, a charger 53*c* and a cleaning blade 53*d*.

The developing device 53*a* houses developing agent. The toner is contained in the developing agent. The developing device 53*a* attaches the toner to the photoconductive drum 53*b*.

The photoconductive drum 53*b* is one of concrete examples of an image carrier (image bearing module). The photoconductive drum 53*b* has a photoconductor (photoconductive area) on the outer peripheral surface thereof. For example, the photoconductor is an OPC (organic photoconductor).

The charger 53*c* uniformly charges the surface of the photoconductive drum 53*b*.

The cleaning blade 53*d* removes the toner attached to the photoconductive drum 53*b*.

Next, operations of the image forming section 53 are schematically described.

The photoconductive drum 53*b* is charged to a predetermined electric potential by the charger 53*c*. Next, the light from the exposure section 51 is emitted to the photoconductive drum 53*b*. In this way, the electric potential of the area which is irradiated with the light in the photoconductive drum 53*b* changes. Through the change, an electrostatic latent image is formed on the surface of the photoconductive drum 53*b*. The electrostatic latent image formed on the surface of the photoconductive drum 53*b* is developed through the developing agent in the developing device 53*a*. In other words, the image developed by the toner (hereinafter, referred to as a "developed image") is formed on the surface of the photoconductive drum 53*b*.

The transfer roller 54 faces the photoconductive drum 53*b*. The transfer roller 54 transfers the developed image formed on the surface of the photoconductive drum 53*b* onto the sheet S.

Next, the fixing section 60 is described.

The fixing section 60 applies heat and pressure to the sheet S. The fixing section 60 fixes the toner image transferred tonto the sheet S through the heat and the pressure. The sheet S on which the image is fixed through the fixing section 60 is discharged to the discharge tray 80. Alternatively, the sheet S on which the image is fixed through the fixing section 60 is conveyed to the reversing unit 70.

Next, the reversing unit 70 (discharge mechanism) is described.

The reversing unit 70 reverses the sheet S conveyed from the fixing section 60 through switchback. The reversing unit 70 conveys the reversed sheet S to the front of the resist roller 44 again. The reversing unit 70 reverses the sheet S to form a toner image on the back surface of the sheet S to which the fixing processing is executed. Alternatively, the reversing unit 70 discharges the sheet S to the discharge tray 80 so as to irradiate a printing surface of the sheet S with the UV light.

Next, the discharge tray 80 is described.

The discharge tray 80 is positioned at the downstream side of the image forming section 50 in the conveyance direction of the sheet S. Herein, the "downstream side" refers to the downstream side of the fixing section 60 in the conveyance direction of the sheet S in a case in which the sheet S passing the fixing section 60 is discharged to the discharge tray 80.

The discharge tray 80 is a discharge tray in a body. In other words, the discharge tray 80 is positioned at the inside of a casing (inside of a main body) of the image forming apparatus 1. An outlet 80*a* of the sheet S discharged to the discharge tray 80 is formed in the image forming apparatus 1. The outlet 80*a* is opened at a lateral side of the casing of the image forming apparatus 1 in a manner of facing the discharge tray 80.

Next, the irradiation section 90 is described.

The irradiation section 90 is equipped with a specific light source 91 and an ordinary light source 92.

The specific light source 91 irradiates the sheet S with the UV light at the downstream side of the image forming section 50 in the conveyance direction of the sheet S. The specific light source 91 irradiates the sheet S discharged to the discharge tray 80 with the UV light. The specific light source 91 is a UV light (otherwise known as black light).

The specific light source 91 emits the UV light towards the sheet S from the outlet 80*a*. In other words, the irradiation section of the UV light in the specific light source 91 faces an opposite side to the outlet 80*a*. The whole sheet S discharged to the discharge tray 80 is irradiated with the UV light from the specific light source 91.

The ordinary light source 92 emits the visible light to the sheet S at the downstream side of the image forming section 50 in the conveyance direction of the sheet S. The ordinary light source 92 emits the visible light to the sheet S discharged to the discharge tray 80. For example, the ordinary light source 92 is an LED.

The ordinary light source 92 emits the visible light towards the sheet S from the reversing unit 70 side. In other words, the irradiation section of the visible light in the ordinary light source 92 faces the outlet 80*a* side. The whole sheet S discharged to the discharge tray 80 is irradiated with the visible light from the ordinary light source 92.

Figure 3:
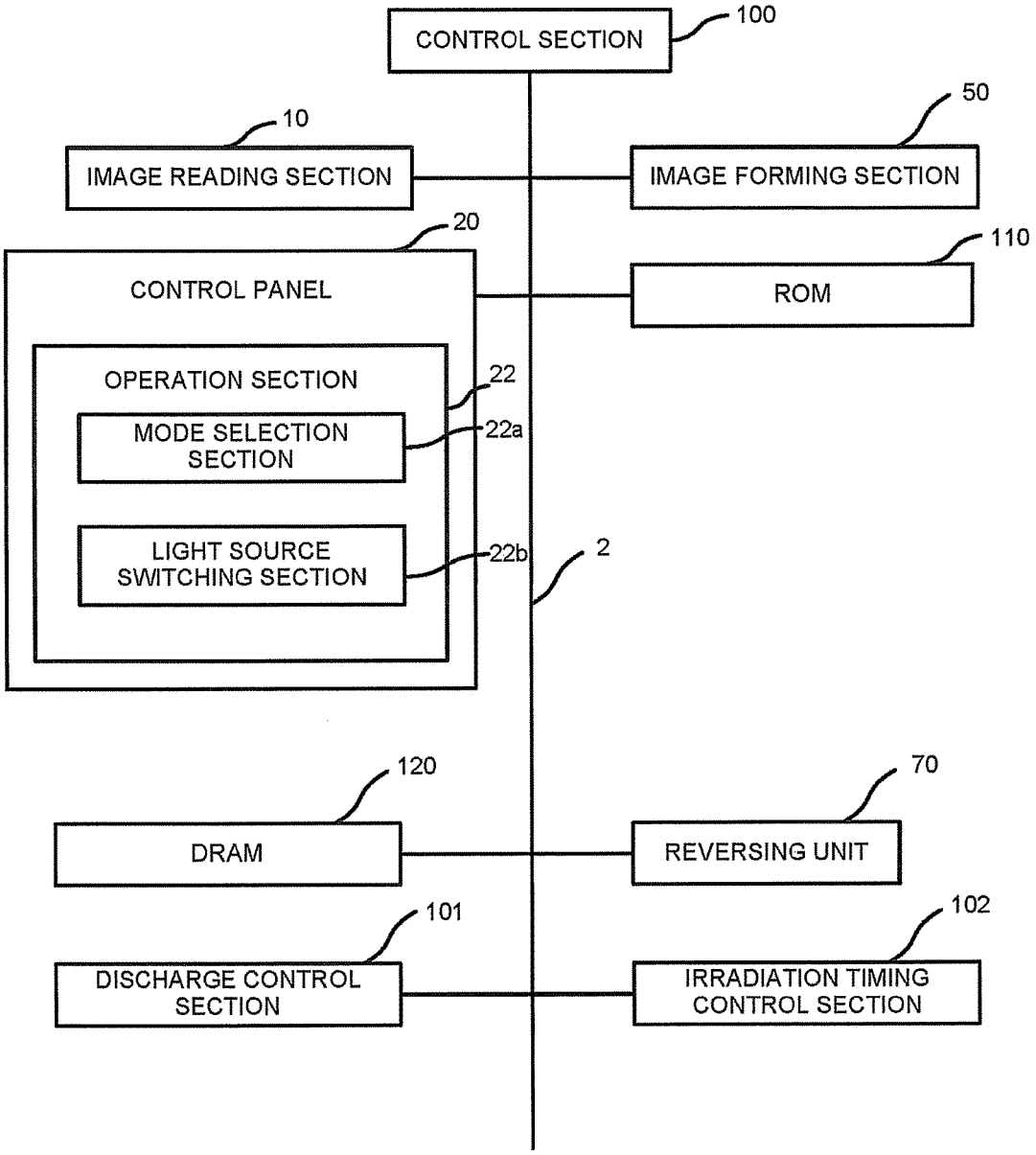
FIG. 3 is a block diagram illustrating an example of the schematic configuration of functional blocks of the image forming apparatus according to the embodiment.

FIG. 3 is a block diagram illustrating an example of the schematic configuration of functional blocks of the image forming apparatus 1 according to the embodiment.

The control section 100 is connected with each functional section via a system bus 2 in a data communicable manner. The control section 100 controls each functional section. The functional sections include the image reading section 10, the control panel 20, the image forming section 50, a discharge control section 101, an irradiation timing control section 102, a ROM (Read Only Memory) 110 and a DRAM (Dynamic Random Access Memory) 120.

Hereinafter, an example of the processing of the control section 100 is described.

The control section 100 controls each functional section based on an output signal from the control panel 20.

For example, the control section 100 controls the pickup rollers 31*a* and 32*a* (refer to FIG. 2) to convey the sheet S from the sheet feed cassettes 31 and 32 in response to the instruction from the user.

For example, the control section 100 controls to switch a print mode. Hereinafter, as categories of the print mode, a mode in which the image is formed on the sheet S with the UV toner is referred to as a "UV print mode (specific print mode)", and a mode in which the image is formed on the sheet S with the ordinary toner is referred to as an "ordinary print mode".

The operation section 22 is equipped with a mode selection section 22*a* capable of selecting the UV print mode and the ordinary print mode. For example, the mode selection section 22*a* is a button arranged on the operation section 22. Through pressing the button to select the "UV print mode" at the time of selecting the print mode by the user, the control section 100 controls the image forming section 50 to form the image on the sheet S with the UV toner. on the other hand, through pressing a button to select the "ordinary print mode" at the time of selecting the print mode by the user, the control section 100 controls the image forming section 50 to form the image on the sheet S with the ordinary toner image.

For example, the control section 100 controls to switch the irradiation section 90 (refer to FIG. 2).

The operation section 22 is equipped with a light source switching section 22*b* capable of switching the specific light source 91 and the ordinary light source 92. For example, the light source switching section 22*b* is a button arranged on the operation section 22. Through pressing the button to select the "UV light" by the user, the control section 100 controls the irradiation section 90 to enable the specific light source 91 to emit the UV light. On the other hand, through pressing the button to select the "visible light" by the user, the control section 100 controls the irradiation section 90 to enable the ordinary light source 92 to emit the visible light.

For example, the control section 100 controls the reversing unit 70 to discharge the sheet S to the discharge tray 80 (refer to FIG. 2) so that the printing surface of the sheet S is irradiated with the UV light. In other words, the control section 100 controls the reversing unit 70 to reverse the sheet S to which the fixing processing is executed to the discharge tray 80.

Herein, an example of the function of the reversing unit 70 is described.

Figure 4:
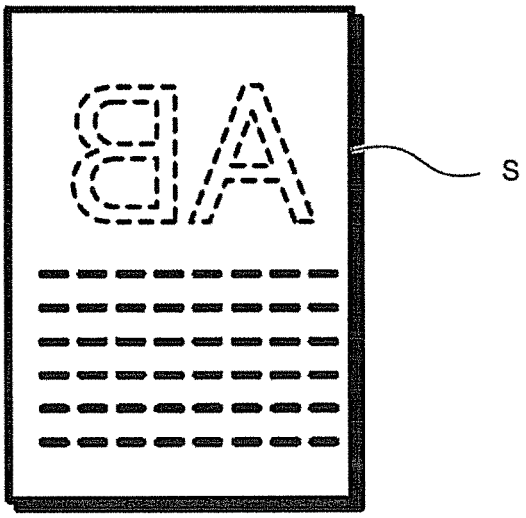
FIG. 4 is a diagram illustrating an example of a back surface of a sheet discharged to a discharge tray according to the embodiment.

FIG. 4 is a diagram illustrating an example of the back surface of the sheet S discharged to a discharge tray according to the embodiment.

Hereinafter, a case in which UV printing is carried out to one surface (front surface) of the sheet S, and the UV printing is not carried out to the other surface (back surface) of the sheet S is referred to as "UV simplex printing". In a case of the UV simplex printing, if the sheet S to which the fixing processing is executed is not reversed, the sheet S is discharged to the discharge tray 80 in a state of the back surface. Therefore, even the UV light from the specific light source 91 is emitted to the sheet S, the UV light is blocked by the back surface of the sheet S. Therefore, the printing surface (front surface) of the sheet S is not irradiated with the UV light.

Figure 5:
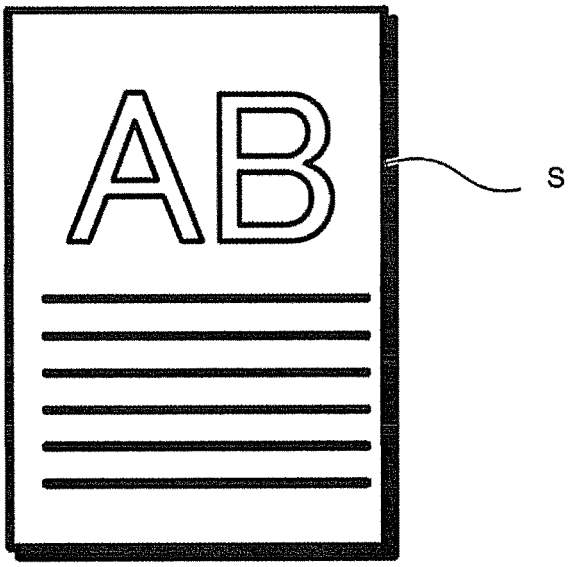
FIG. 5 is a diagram illustrating an example of a front surface of the sheet discharged to the discharge tray according to the embodiment.

FIG. 5 is a diagram illustrating an example of the front surface of the sheet S discharged to the discharge tray 80 according to the embodiment.

In the present embodiment, through the control of the reversing unit 70, the sheet S to which the fixing processing is executed is reversed to be discharged to the discharge tray 80. Therefore, the sheet S is discharged to the discharge tray 80 in the state of the front surface. Therefore, the UV light from the specific light source 91 is emitted to the printing surface (front surface) of the sheet S.

Next, the discharge control section 101 is described.

As shown in FIG. 3, the control section 100 controls the discharge control section 101 at the time a plurality of the sheets S is discharged. The discharge control section 101 controls the printing and discharge operation executed to a plurality of the sheets S in such a manner that the sheets S are discharged to the discharge tray 80 in order starting from the final sheet S at the time a plurality of the sheets S is discharged.

Next, the irradiation timing control section 102 is described.

The control section 100 controls the irradiation timing control section 102 at the time the UV light is emitted to the sheet S. The irradiation timing control section 102 controls the timing at which the UV light is emitted to the sheet S immediately after the sheet S is discharged to the discharge tray 80. The irradiation timing control section 102 controls the specific light source 91 to emit the UV light to the sheet S immediately after the sheet S is discharged to the discharge tray 80.

The ROM 110 stores various control programs necessary for the control section 100 to operate.

The DRAM 120 is used as a temporary storage area of data at the time the control section 100 executes the program.

Incidentally, there is an image on the image receiving medium such as a barcode for sorting postcards which is desired to be not visually recognized through irradiation of the visible light. In this case, an image that is visually recognizable through irradiation of the specific light such as UV light is formed on the image receiving medium. However, in a case in which the image on the image receiving medium is visually recognizable through the irradiation of the specific light, even the discharged image receiving medium is irradiated with the visible light, there is a possibility that whether the image is normally printed on the image receiving medium cannot be confirmed.

According to the embodiment, the image forming apparatus is equipped with the image forming section 50 and the specific light source 91. The image forming section 50 forms the image on the sheet S with the UV toner which emits the visible light through the irradiation of the UV light. The specific light source 91 emits the UV light to the sheet S at the downstream side of the image forming section 50 in the conveyance direction of the sheet S. With the foregoing configuration, the following effect is achieved. In a case in which the image on the sheet S is visually recognizable through the irradiation of the UV light, through emitting the UV light to the discharged sheet S, the image on the sheet S can be visually recognized. Thus, whether the image is normally printed on the sheet S can be confirmed.

The specific light source 91 emits the UV light to the sheet S discharged to the discharge tray 80, and thus, the following effect is achieved. As the UV light can be emitted to the sheet S in a state in which the sheet S is still, whether the image is normally printed on the sheet S is easily confirmed. In addition, compared with a case in which the UV light is emitted to the sheet S when the sheet S is being conveyed, the UV light is easily emitted to the sheet S.

The image forming apparatus 1 is equipped with the reversing unit 70 configured to discharge the sheet S to the discharge tray 80 so as to irradiate the printing surface of the sheet S with the UV light, and thus, the following effect is achieved. As the UV light from the specific light source 91 is emitted to the printing surface of the sheet S, the image on the sheet S can be easily visually recognized.

The image forming apparatus 1 is equipped with the discharge control section 101 configured to control the printing and the discharge operation executed to a plurality of the sheets S in such a manner that the sheets S are discharged to the discharge tray 80 in order starting from the final sheet S at the time a plurality of the sheets S is discharged. With the foregoing configuration, the following effect is achieved. Even in a case in which a plurality of the sheets S is discharged to the discharge tray 80 in such a manner that the printing surfaces of the sheets S are irradiated with the UV light, the order of the pages is prevented from being reversed.

The specific material is the UV toner, and the specific light source 91 is the UV light, and thus, the following effect is achieved. Whether the image is normally printed on the sheet S can be confirmed with a simple configuration using the UV toner and the UV light.

The image forming apparatus 1 is equipped with the mode selection section 22*a* capable of selecting the UV print mode and the ordinary print mode, and thus, the following effect is achieved. The print mode can be easily selected matching with needs of the user.

The image forming apparatus 1 is equipped with the light source switching section 22*b* capable of switching the specific light source 91 and the ordinary light source 92, and thus, the following effect is achieved. The light emitted to the sheet S can be easily switched to at least one of the UV light and the visible light matching with needs of the user.

The discharge tray 80 is the discharge tray in the body, and thus, the following effect is achieved. As the discharge tray 80 is positioned at the inside of the casing (inside of the main body) of the image forming apparatus 1, the compactification of the image forming apparatus 1 can be realized.

The image forming apparatus 1 is equipped with the irradiation timing control section 102 configured to control the timing at which the UV light is emitted to the sheet S immediately after the sheet S is discharged to the discharge tray 80, and thus, the following effect is achieved. Compared with a case in which the UV light is emitted to the sheet S after prescribed time elapses from the moment the sheet S is discharged to the discharge tray 80, as the UV light is emitted to the sheet S for a long time, the image on the sheet S can be easily visually recognized.

The specific light source 91 emits the UV light towards the sheet S from the outlet 80*a* of the sheet S, and thus, the following effect is achieved. In a case of taking out the sheet S from the outlet 80*a* by the user, it can be prevented that the user looks at the UV light directly. Thus, the image on the sheet S can be easily visually recognized from the outlet 80*a*.

Hereinafter, modifications are described.

The specific light source 91 is not limited to emitting the UV light to the sheet S discharged to the discharge tray 80. For example, the specific light source 91 may emit the UV light to the sheet S when the sheet S is being conveyed. In this case, the interval between the sheets S or the conveyance speed of the sheet S may be changeable so as to easily visually recognize the sheet S that is being conveyed.

The discharge tray 80 is not limited to the discharge tray in the body. For example, the discharge tray may protrude towards the outside of the casing (outside of the main body) of the image forming apparatus 1.

The ordinary light source 92 is not limited to emitting the visible light towards the sheet S from the reversing unit 70 side. For example, the ordinary light source 92 may emit the visible light towards the sheet S from the outlet 80*a*.

According to at least one embodiment described above, the image forming apparatus is equipped with the image forming section 50 and the specific light source 91. The image forming section 50 forms the image on the sheet S with the UV toner which emits the visible light through the irradiation of the UV light. The specific light source 91 emits the UV light to the sheet S at the downstream side of the image forming section 50 in the conveyance direction of the sheet S. With the foregoing configuration, the following effect is achieved. In a case in which the image on the sheet S is visually recognizable through the irradiation of the UV light, through emitting the UV light to the discharged sheet S, the image on the sheet S can be visually recognized. Thus, whether the image is normally printed on the sheet S can be confirmed.

Other than in the operating examples, or where otherwise indicated, all numbers, values and/or expressions referring to quantities of ingredients, reaction conditions, etc., used in the specification and claims are to be understood as modified in all instances by the term "about."

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. An image forming apparatus, comprising:

an image forming section configured to form an image on an image receiving medium with a specific material which emits visible light through irradiation by specific light;

a specific light source configured to emit the specific light to the image receiving medium at a downstream side of the image forming section in a conveyance direction of the image receiving medium; and a discharge tray to which the image receiving medium is discharged at the downstream side of the image forming section in the conveyance direction of the image receiving medium, wherein the specific light source emits the specific light to the image receiving medium discharged to the discharge tray.

2. The image forming apparatus according to claim 1, further comprising a discharge mechanism configured to discharge the image receiving medium to the discharge tray so that the specific light is emitted to a printing surface of the image receiving medium.

3. The image forming apparatus according to claim 2, further comprising a discharge control section configured to control printing and discharge operation executed to a plurality of the image receiving media in such a manner that the image receiving media are discharged to the discharge tray in order starting from a final the image receiving medium at the time a plurality of the image receiving media is discharged.

4. The image forming apparatus according to claim 1, wherein the specific material comprises a UV toner; and the specific light source emits a UV light.

5. The image forming apparatus according to claim 1, further comprising a mode selection section capable of selecting a UV print mode for forming an image on the image receiving medium with the specific material and an ordinary print mode for forming an image on the image receiving medium with an ordinary material that is visually recognizable with visible light.

6. The image forming apparatus according to claim 5, further comprising an ordinary light source configured to emit visible light to the image receiving medium; and a light source switching section capable of switching between the specific light source and the ordinary light source.

7. The image forming apparatus according to claim 1, wherein the discharge tray is comprised in a main body of the image forming apparatus.

8. The image forming apparatus according to claim 1, further comprising an irradiation timing control section configured to control timing at which the specific light is emitted to the image receiving medium immediately after the image receiving medium is discharged to the discharge tray.

9. The image forming apparatus according to claim 1, wherein the specific light source emits the specific light towards the image receiving medium from an outlet of the image receiving medium.

10. An image forming method, comprising:

forming an image on an image receiving medium with a specific material which emits visible light through irradiation by specific light;

emitting the specific light to the image receiving medium at a downstream position in a conveyance direction of the image receiving medium;

discharging the image receiving medium to a discharge tray at the downstream side in the conveyance direction; and emitting the specific light to the image receiving medium on the discharge tray.

11. The image forming method according to claim 10, wherein the specific light has a wavelength from 10 nm to 380 nm.

12. The image forming method according to claim 10, wherein the visible light has a wavelength from 400 nm to 700 nm.

13. The image forming method according to claim 10, wherein the specific material comprises a UV toner and the specific light is UV light.

14. The image forming method according to claim 10, further comprising forming an image on the image receiving medium with an ordinary material that is visually recognizable with visible light.

15. The image forming method according to claim 14, further comprising emitting visible light to the image receiving medium; and switching between emitting specific light and emitting ordinary light.

16. The image forming method according to claim 10, further comprising controlling a timing at which the specific light is emitted to the image receiving medium immediately after the image receiving medium is discharged to the discharge tray.

* * * * *